United States Patent [19]

Matsumoto

[11] 4,290,605

[45] Sep. 22, 1981

[54] GAME HAVING PATHWAY TRAVERSING A PLURALITY OF INDEPENDENT OBJECT TRANSFER MECHANISMS

[75] Inventor: Takao Matsumoto, Tokyo, Japan

[73] Assignee: Tomy Kogyo Co., Inc., Tokyo, Japan

[21] Appl. No.: 106,454

[22] Filed: Dec. 26, 1979

[30] Foreign Application Priority Data

Dec. 25, 1978 [JP] Japan ..... 53-180518[U]

[51] Int. Cl.[3] ..... A63F 7/00; A63H 33/00

[52] U.S. Cl. ..... 273/110; 46/43; 273/120 R; 273/399

[58] Field of Search ..... 273/110, 109, 108, 117, 273/399, 357; 46/40, 43

[56] References Cited

U.S. PATENT DOCUMENTS

| | | | |
|---|---|---|---|
| 469,948 | 3/1892 | Reed . | |
| 3,298,692 | 1/1967 | Glass et al. . | |
| 3,300,891 | 1/1967 | Glass et al. . | |
| 3,720,412 | 3/1973 | Ramirez | 273/86 R |
| 3,879,039 | 4/1975 | Holden | 273/110 |
| 4,143,875 | 3/1979 | Browning et al. | 273/315 |

*Primary Examiner*—Richard C. Pinkham

*Assistant Examiner*—Scott L. Brown

*Attorney, Agent, or Firm*—K. H. Boswell; Edward D. O'Brian

[57] ABSTRACT

A game of skill has a support housing on which there are located a plurality of independent object transfer mechanisms preferably no two which are identical. The transfer mechanisms are aligned in a sequence such that a pathway includes a plurality of discontinuities along its length which divides it into a plurality of segments. Each of the transfer mechanisms includes one segment of the pathway and some of the transfer mechanisms can also include more than one segment. This creates a discontinuity in the pathway between each of the transfer mechanisms as well as between each segment when more than one segment is found on one transfer mechanism. Each of the transfer mechanisms includes a movable portion which is moved by the operator of the game via a control mechanism attached thereto. By manipulating the control mechanisms a spherical object can be caused to travel across the pathway. The object traverses the discontinuity in the pathway by a realignment of the segments achieved by moving the movable portion of the object transfer mechanisms.

16 Claims, 6 Drawing Figures

GAME HAVING PATHWAY TRAVERSING A PLURALITY OF INDEPENDENT OBJECT TRANSFER MECHANISMS

BACKGROUND OF THE INVENTION

This invention is directed to a game of skill wherein a sperical object is caused to travel across a pathway through a plurality of object transfer mechanisms, on which the pathway is located, by causing a portion of the object transfer mechanisms to move and realign themselves.

Several games are known wherein a circular or spherical object such as a coin or ball is passed from one point to the next. One of these games, described in U.S. Pat. No. 469,948, is directed to a game wherein a plurality of pivotal containers spaced in an alternate relationship, one above the other are capable of passing a ball from one container to the next because of the change in the center of gravity of the container which holds the object. When the object is deposited in the container the container becomes top heavy and rotates about its pivot point until the object is dispensed from the container into the next container.

Another of these games, described in U.S. Pat. No. 3,720,412, has a plurality of cup-like containers which are arranged in a horizontal row. Each container has a handle. By manipulating the handle the containers are tilted allowing a ball to be transferred from one container to the next.

In a different type of game described in U.S. Pat. No. 3,879,039 a ball is caused to travel over a see-saw like track by tilting sections of the track in a see-saw manner. The track contains a plurality of these individual sections which are connected together and each section pivots about a central fulcrum. Thus when one end of one section is depressed the other end is raised and this motion is propogated through the sections. The ball is moved across the sections by coordinating pivoting of the sections with movement of the ball.

Several games are known which contain what could be described as "Rube Goldberg" type mechanisms. These mechanisms are sort of far fetched arrangements wherein one event or movement of one object precipitates the movement of the second object such as "a cat chases a mouse and in turn is chased by a dog who in turn pulls a chain attached to the dog house pulling the dog house, etc." Two of these types of games are described in U.S. Pat. Nos. 3,298,692 and 3,300,891. In both of these patents a complex series of event happen in a chain reaction because of an instability or movement passed from one component to the next. Included in these games is the movement of a spherical object over a path. However, movement of the spherical object in these games is totally under the influence of gravity and is not under the direct control of the operator of the game.

No games are known which include a series of unrelated complex events such as the two games described in the immediately preceding paragraph, but which require the operator of the game to control the movement of an object such as the three games initially described. It is considered that such a game could develop manual dexterity in coordinating the movement of an object, would be very fascinating and stimulating and thus have good play value.

In view of the above preceding discussion it is an object of this invention to provide a game of skill which encompasses a plurality of complex and independent mechanisms over which it is required to manipulate an object. It is a further object to provide a game that even though it is complex in its operation it is simple in regards to its components and manufacturing of the same thus yielding a game which is easily manufactured and economic to produce.

These and other objects as will be evident from the remainder of this specification are achieved by providing a game of skill which comprises: a support housing, a plurality of independent object transfer mechanisms of at least two nonidentical types located on the housing and arranged in a sequence with respect to one another and having at least a portion of each of the transfer mechanisms movable with respect to said housing, a plurality of control means located on the housing in a manner to operatively connect each of the control means to at least one of the object transfer mechanisms such that the movable portions of each of the plurality of the object transfer mechanisms is movable with respect to the housing in response to the control mechanisms, an object pathway passes through the sequence of the object transfer mechanisms and includes a starting end and a finishing end, in between the starting end and the finishing end the pathway is divided by a plurality of discontinuities into segments such that a segment exists between each two adjacent discontinuities and a discontinuity exists between each two adjacent segments, a spherical object is caused to move over the pathway by traveling over each individual segment between each two adjacent discontinuities by moving the movable portion of the object transfer means containing that segment and across discontinuities connecting two segments which are located on adjacent object transfer means by moving the movable portion of at least one of the object transfer means which contains the two adjacent segments and across discontinuities connecting two adjacent segments located on a singular object transfer means by moving the movable portion of the object transfer means containing the two adjacent segments, said spherical object is capable of traveling from the starting end to the finishing end of the pathway when it successfully travels over all of the segments and traverses all of the discontinuities.

The object moves over the segments by either rolling, being carried over or being propelled. At least one of the object transfer mechanisms can include a plurality of surfaces connected together and each supported by a fulcrum such that the surfaces can be moved in unison in a wavelike pattern. Another of the transfer mechanisms can include a mechanism which is rotatably mounted on the housing and includes an object holding means such that as the mechanism is rotated on the housing the object moves in an arculate pathway. Another of the mechanisms can include a surface which is supported on the housing in a tiltable manner such that it is capable to tilt the surface in any direction to cause the object to be able to role across the surface in any direction. Another of the transfer mechanisms can include the feature delineated in the previous sentence but further modified to provide a plurality of barriers forming a maze on the surface. A further transfer mechanism can include an arm pivotally mounted to the housing such that when the object is located in a holding means on the arm opposite the pivot the object can be swung in an arc and then ejected from the holding means.

BRIEF DESCRIPTION OF THE DRAWINGS

This invention will be better understood when taken in conjunction with the drawings wherein.

Figure 1:
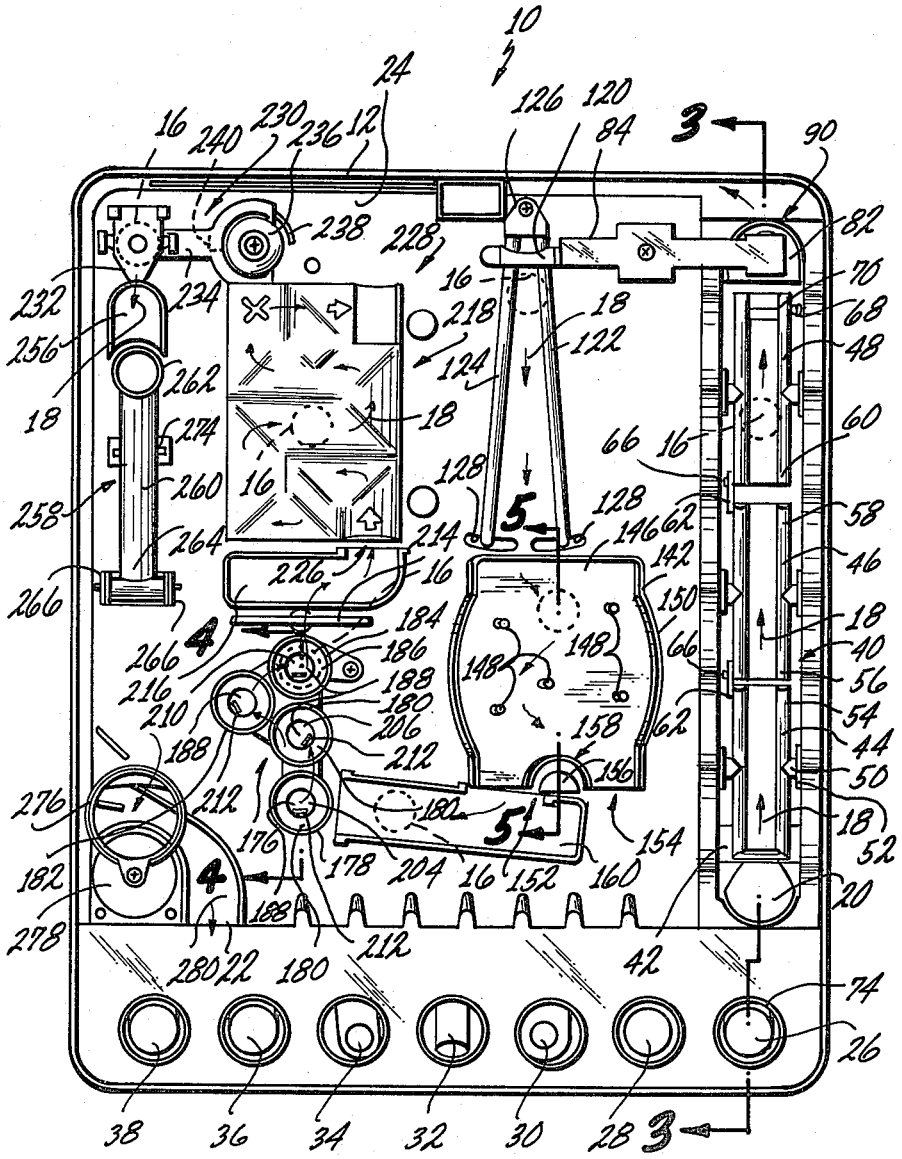
FIG. 1 shows a top plan view of the invention.
Figure 2:
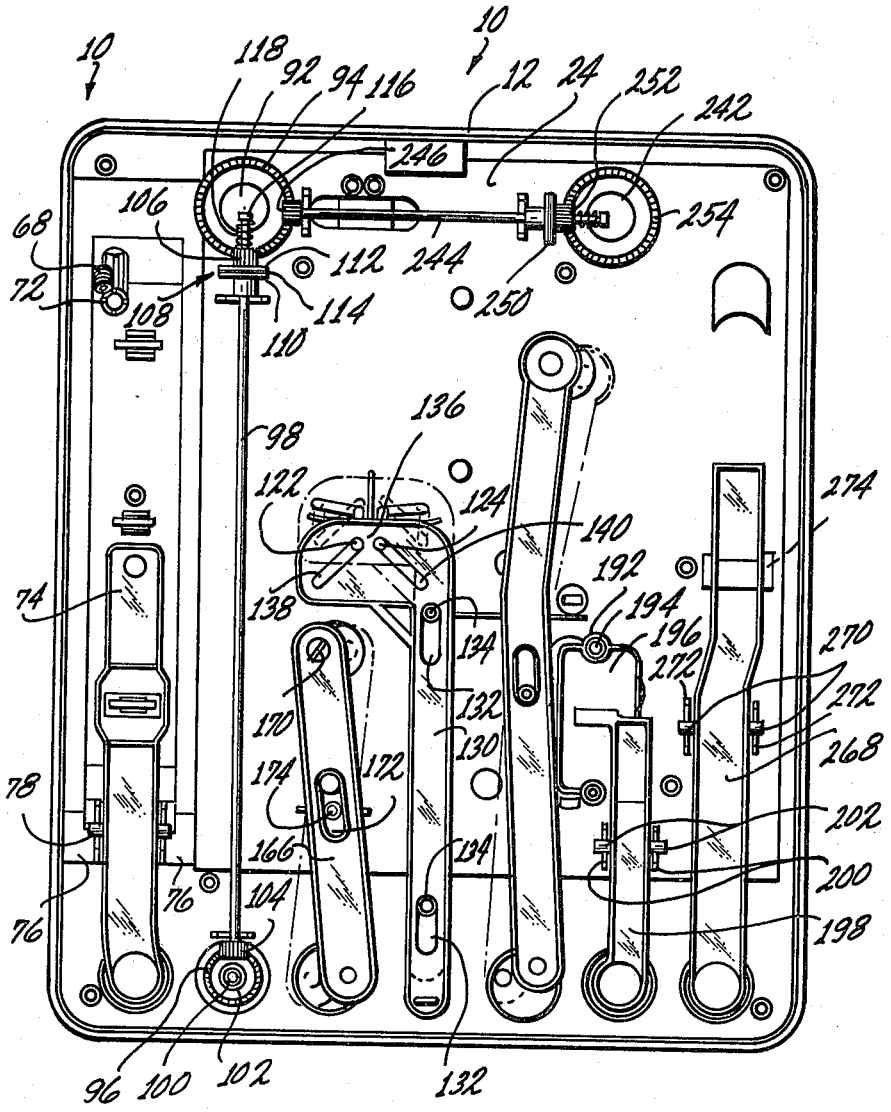
FIG. 2 is a bottom plan view of the invention shown in FIG. 1 except that the bottom cover has been removed to expose components within the invention.
Figure 3:
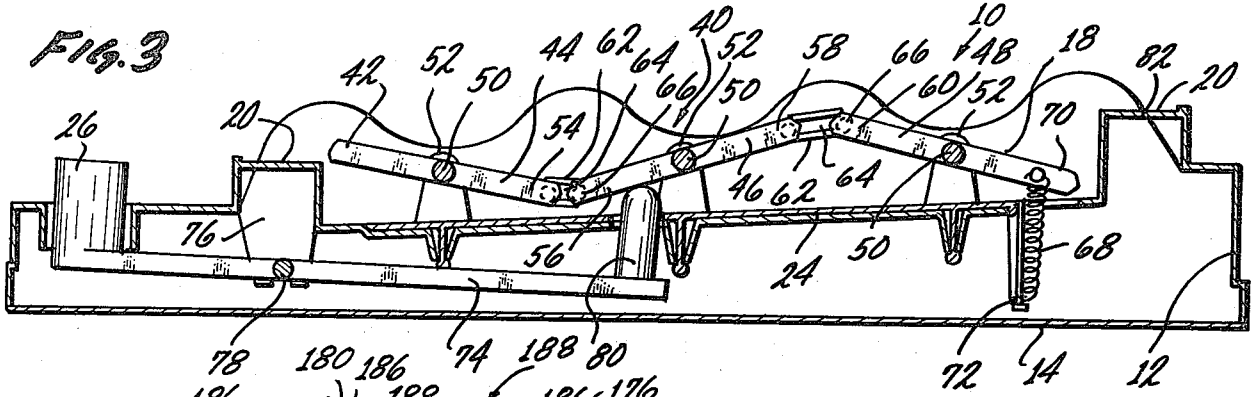
FIG. 3 is a side elevational view about the line 3—3 of FIG. 1.
Figure 4:
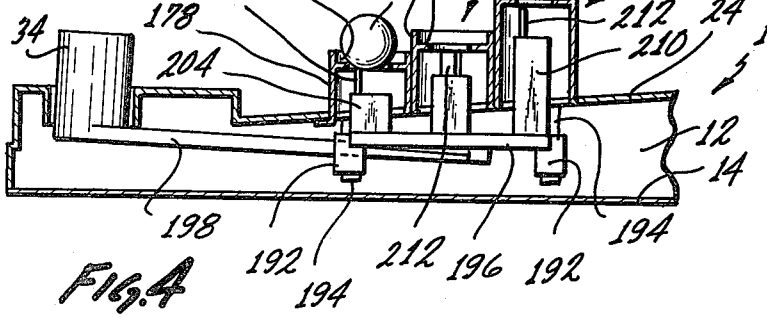
FIG. 4 is a side elevational view in partial section about the line 4—4 of FIG. 1.
Figure 5:
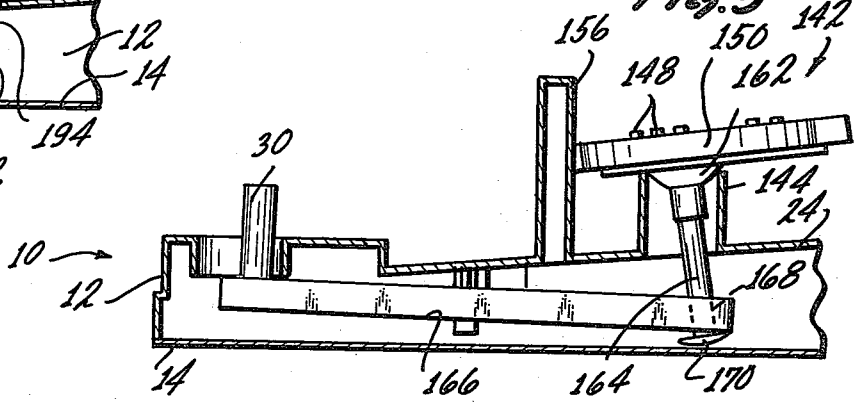
FIG. 5 is a side elevational view about the line 5—5 of FIG. 1.
Figure 6:
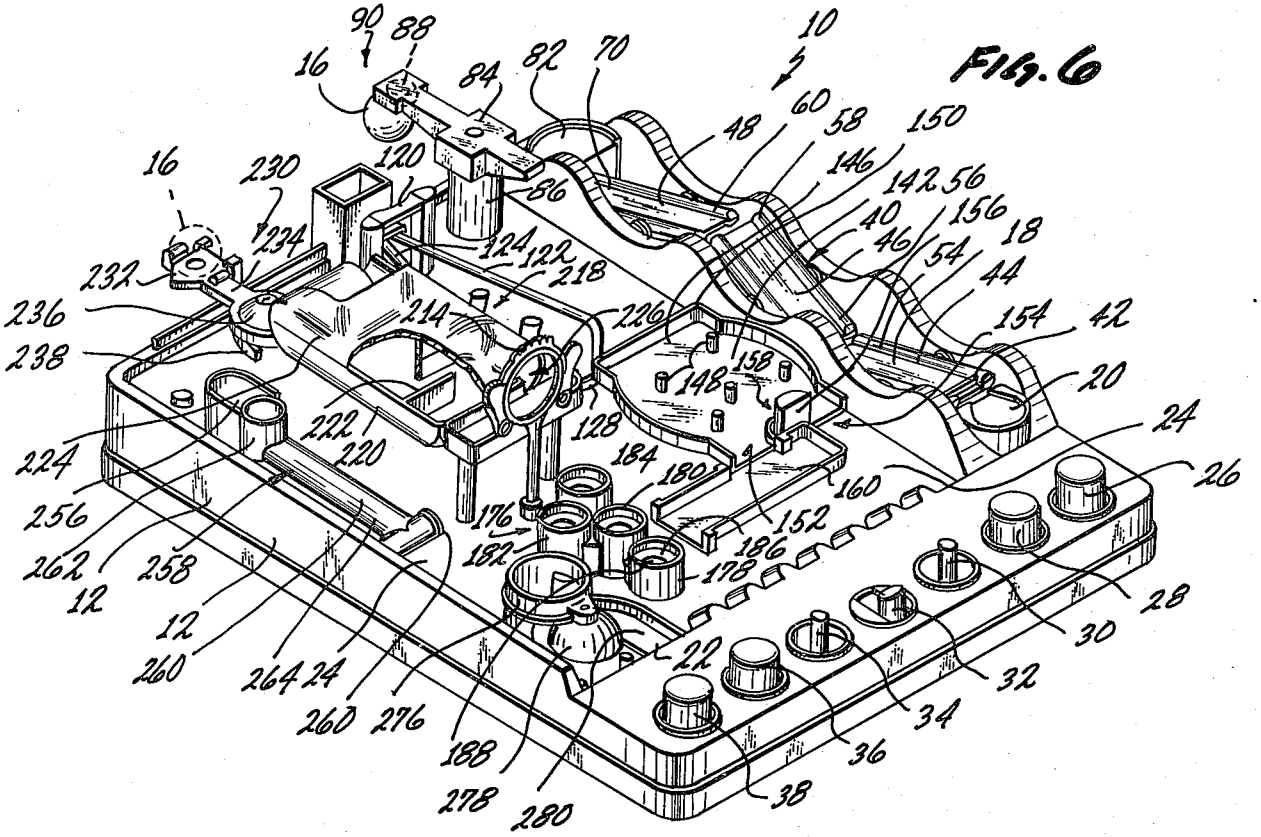
FIG. 6 is an isometric view of the top, front and left hand side of the invention showing certain of the components of the invention in partial section and/or in a different spacial relationship with respect to the spacial relationship depicted in FIG. 1 and including a plurality of objects, shown in phantom, illustrating how the singular object of the invention is acted on by individual components of the invention.

The toy illustrated in this specification utilizes certain principles and concepts as are set forth and defined in the amended claims forming a part of this specification. It is to be realized that those experienced in the toy design arts could utilize these principles and/or concepts in a number of differently appearing embodiments without departing from the spirit or scope of this invention. For this reason this invention is to be construed in light of the appended claims and should not be construed as being limited solely to the embodiment illustrated in the specification and the drawings.

DETAILED DESCRIPTION

The game 10 has a housing component 12 which has a bottom 14 attaching thereto using conventional attaching methods. It is an object of the game to manipulate a spherical object 16, hereinafter referred to as the ball, across the surface of a plurality of object transfer mechanisms, hereinafter individually described and numbered, in as short of a period of time as possible.

Each of the object transfer mechanisms utilize a different principle to transfer the ball from one point to the next. When taken together all of the object transfer mechanisms in conjunction with some stationary parts, also hereinafter described, form a pathway 18 which traverses across the housing 12 from a starting end 20 to a finishing end 22.

The housing 12 has a gently sloping upper surface 24 having a plurality of extensions and projections, not numbered at this point, to which the object transfer mechanisms are attached. Because of the sloping surface 24 if the ball 16 is not correctly manipulated across any of the object transfer mechanisms it will be dropped or deposited on the sloping surface 24 which will allow it to roll back toward the operator of the game so that the operator of the game will once again have to position the ball at the starting end 20 and again attempt to cause the ball 16 to traverse across the pathway 18 to the finishing end 22. A plurality of control mechanisms 26 through 38 are located on the housing 12 immediately in front of the operator of the game. As hereinafter described these control mechanisms are operatively connected to the plurality of object transfer mechanisms allowing the operator of the game to move at least a portion of each of the object transfer mechanisms in order to successfully manipulate the ball 16 across the pathway 18.

The operator of the game is required to manipulate the transfer of the ball 16 from one object transfer mechanism to the next. The object transfer mechanisms are aligned in sequence across the surface 24 such that the pathway 18 is continuous through the sequence, however, between each two adjacent object transfer mechanisms of the sequence it is necessary to move the ball 16 from one transfer mechanism to the next. This transfer requires skill in that it is possible to unsuccessfully transfer the ball 16 between every two adjacent transfer mechanisms thus causing the ball to be deposited on the surface 24 requiring the operator of the game to start over again.

For the purposes of this specification the spaces between and/or the manipulative activity required in transferring the ball 16 between one transfer mechanism to the next will be considered as being a discontinuity in the pathway 18. Additionally, as hereinafter described, some of the transfer mechanisms are composed of a plurality of functions which require the operator of the game to manipulate the ball 16 from one function to the next within an individual transfer mechanism. The potential also exists within this game for the operator to unsuccessfully complete this transfer, therefore again for the purposes of this specification, it will be considered that discontinuities also exist within the pathway 18 on individual object transfer mechanisms. Each portion of the pathway 18 between any two consecutive discontinuities will, for the purposes of the specification, be considered as a segment of the pathway 18.

The first object transfer means is a movable ramp 40 controlled by control mechanism 26. Movable ramp 40 is located on the right hand side of the game 10 and has one end 42 adjacent to starting end 20 of pathway 18. Within movable ramp 40 are three individual ramps 44, 46 and 48. Each of the ramps 44, 46 and 48 is suspended at its center by identical axles 50 which fit into bearing surfaces collectively identified by the numeral 52. The ramps 44, 46 and 48 are thus first class levers. End 54 of ramp 44 is connected to end 56 of ramp 46 and end 58 of ramp 46 is connected to end 60 of ramp 48 as follows. An ear collectively identified by the numeral 62 is located on ends 54 and 58 of ramps 44 and 46. The ears 62 have cutouts 64 in their center. Pegs 66 located on ends 56 and 60 of ramps 46 and 48 fit into the cutouts 64 and are free to move back and forth within the cutouts 64. The interaction of the pegs 66 with the cutouts 64 connect the ramps 44, 46 and 48 together so that motion of one of the ramps is transferred to the other remaining ramps. A spring 68 is connected between the end 70 of ramp 48 and a boss 72 projecting downwardly from the bottom of housing 12. This biases end 70 downwardly and consequently influences the position of all of the ramps 44, 46 and 48.

The position of the ramps 44, 46 and 48 are changeable via control mechanism 26. Control mechanism 26 is part of a first class lever 74 which is appropriately journaled in bearings 76 formed on the underneath side of housing 26 via axles 78 formed on lever 74. On the other end of lever 74 opposite control mechanism 76 is an upstanding boss 80. This boss projects through a hole, not numbered, in housing 12 in a position such that it is underneath end 56 of ramp 46. Normally end 56 of ramp 46 is biased downwardly via spring 68 interacting on ramp 48. When control mechanism 26 is depressed lever 74 pivots about axle 78 causing boss 80 to move upwardly against end 56 raising end 56 and concurrently end 54 of ramp 44 and end 70 of ramp 48. End 40 of ramp 44, end 58 of ramp 46 and end 60 of ramp 48 are caused to descend by this action. When the control mechanism 26 is released the spring 68 pulls down on end 70 of ramp 48 reversing the position of the ramps.

The ball 16 is caused to move across movable ramp 40 by depressing and releasing control mechanism 26 in conjunction with movement of the ball 16. The ball 16 is located on end 42 of movable ramp 40 by first depressing the control button 26 to lower end 42. The control button is then released causing the ball 16 to roll down ramp 44 and the momentum of the ball 16 going down ramp 44 carries it across the discontinuity between ramp 44 and ramp 46. As soon as the ball 16 is on end 56 of ramp 46 the control mechanism 26 must be depressed causing end 56 of ramp 46 to be elevated. This tilts ramp 46 and allows the ball 16 to roll down it. As soon as the momentum of the ball rolling down ramp 46 carries the ball 16 over the discontinuity between ramp 46 and ramp 48 the control mechanism 26 must be released to elevate end 60 of ramp 48. The ball 16 then rolls down the ramp 48. When it comes to rest at end 70 of ramp 48 the control mechanism 26 is again depressed such that end 70 of ramp 48 lifts the ball 16 onto platform 82 located at the far end of movable ramp 40.

The bearing surfaces 52 of the ramps 44, 46 and 48 are not all on the same horizontal plane, but, in fact, are progressively elevated such that ramp 46 is higher than ramp 44 and ramp 48 is higher than ramp 46. This makes it more difficult to move ball 16 over movable ramp 40 in that the ball 16 must not only traverse the discontinuities within the ramp 40, but must, in fact, travel up hill. In order to successfully traverse the discontinuities and travel up hill the operator of the game must successfully coordinate the transfer of the ball 16 from one ramp to the next in conjunction with proper timing of tilting of the ramps after this transfer has taken place. This is more difficult than if all of the ramps are on the same plane as in previously known devices.

The next object transfer mechanism in the pathway 18 is a magnetic boom. The magnetic boom 84 is rotatably mounted about upstanding boss 86. The boom 84 has a small magnet 88 located on the underside of end 90 of the boom. The magnet 86 is positionable over platform 82 such that when the ball 16 is located on the platform 82 it is susceptible of being magnetically attracted to the magnet 88. The boom 84 is attached to a truncated conical member 92 which fits within the interior of boss 86. A crown gear 94 is located on the lowermost periphery of the member 92. Magnetic boom 84 is controlled by control mechanism 28 as well as is an additional object transfer mechanism hereinafter described. Control mechanism 28 is a knurled knob having a set of crown teeth 96 on its bottom surface. An axle 98 is appropriately journeled on the underside of housing 12 and extends from control mechanism 28 to conical member 92. Control mechanism 28 has a boss 100 extending through its center around which is placed a compression spring 102. Compression spring 102 fits against the bottom 14 and pushes upwardly on control mechanism 28 holding it in place in housing 12.

A pinion 104 is located on the end of axle 98 nearest control mechanism 28. Pinion 104 engages crown teeth 96 and thus transfers rotary movement of control mechanism 28 to axle 98. On the other end of axle 98 is a pinion 106 which is attached to a clutch 108. Pinion 96 engages crown gear 94 and is capable of transferring the rotary motion of axle 98 to the conical member 92 and thus to magnetic boom 84. Clutch 108 is a slip clutch which serves to protect magnetic boom 84 and another object transfer means as hereinafter described from breakage should either control member 28 or magnetic boom 84 be rotated while the other is fixedly held. Clutch 108 is composed of a disk 110 fixedly attached to axle 98 and a disk 112 on which pinion 106 is integrally formed which is freewheeling about axle 98. Interspaced between the disks 110 and 112 is a rubber disk 114 which can frictionally transfer motion of disk 110 to disk 112. A flange 116 is attached to the end of axle 98 and a compression spring 118 interspaced between flange 116 and disk 112 frictionally engages the disks 110 and 112 to the rubber disk 114 yet allows the disks 110 and 112 to be rotated separately from each other shoudl magnetic disk 84 and control mechanism 28 be moved out of unison.

The ball 16 is made of a ferromagnetic material such that it can be attracted to magnet 88 and pivoted by boom 84 from platform 82 to a position locating it next to arch member 120 projecting from housing 12. Two rods 122 and 124 form the next object transfer mechanism in the pathway 18. One end of each of the rods 122 and 124 is pivotally mounted at pivot member 126 associated with and located under arch 120. The other end of the rods 122 and 124 contain an approximately 90 degree bend such that the rods project downwardly toward the housing 12 and fit into identical arculate slots 128. The slots 128 are positioned such that rods 122 and 124 are movable from a position wherein the rods are essentially parallel to a position wherein the rods diverge outwardly from each other over arculate slots 128. The end of the rods 122 and 124 attached to pivot member 126 are depressed with respect to that portion of the rods located over slots 128. Thus, when the rods 122 and 124 are in an essentially parallel relationship the plane in which these two rods lie is sloped toward pivot member 126.

When the ball 16 is swung by the boom 84 it engages arch 120. This retards the ball 16 and further movement of the boom 84, severs the magnetic connection between the magnet 88 and the ball 16 allowing the ball 16 to theoretically drop onto the rods 122 and 124. If movement of the boom 84 is not smooth the ball can be misaligned with respect to the rods 122 and 124 depositing the ball onto surface 24 and not onto the rods. Thus the transfer from the boom 84 to the rods 122 and 124 represents a discontinuity in the pathway 18.

Control member 32 is an upstanding boss located on one end of slidable member 130. Slidable member 130 contains two cutouts collectively identified by the numeral 132 in its surface which are positioned over bosses collectively identified by the numeral 134 which thereby governs the movement of slidable member 130 along a straight line on the bottom of housing 12. Slidable member 130 has a general L shape. At the bottom of the L Shape is a surface 136 having two cutouts 138 and 140 which are oblique to the direction of travel of slidable member 130. The ends of rods 122 and 124 which are located beneath the housing 12 fit within the cutouts 138 and 140. As slidable member 130 is slid back and forth beneath the housing 12, via minipulation of control member 32 by the operator of the game, rods 122 and 124 are brought toward each other and then away from each other as the direction of the slidable member 130 is changed.

When the ball 16 is first deposited on rods 122 and 124 it remains stationary because of the slope of these rods. When the ends of the rods opposite of the pivot member 126 are spread from each other via control mechanism 32 and slidable member 130, the ball 16 starts to roll down the rods 122 and 124 because as the rods 122 and 124 are slowly spread the ball 16 contacts these rods along two points which move from the bottom of the ball 16 upwardly until they approach a configuration wherein the points are located at the ends of a horizontally lying diameter of the ball 16. This allows the ball 16 to roll along the rods against the slope of the rods. The ball 16 can be given sufficient momentum to completely roll along the total length of the rods 122 and 124. However, if the rods 122 and 124 are spread too far from each other it will allow the ball 16 to drop through the rods 122 and 124 onto the surface 24. Thus within the object transfer mechanism defined by the rods 122 and 124 a discontinuity exists within the pathway 18.

The next object transfer mechanism within the sequence of the pathway 18 is tiltable platform 142. Tiltable platform 142 is under the control of control mechanism 30. It is movable in a tiltable manner about upstanding boss 144. If its end 146 is depressed toward surface 24, as hereinafter dessribed, the operator of the game 10 can successfully transfer the ball from the rods 122 and 124 and platform 142. If end 146 is raised, however, when the ball 16 rolls down the rods 122 and 124 the ball will not successfully be transferred to the platform 142.

Platform 142 contains a plurality of upstanding bosses collectively identified by the numeral 148 on its surface which interfere with the travel of ball 16 across its surface. The platform has an upstanding flange 150 which circumvents its perimeter, except for two openings 152 and 154 located opposite end 146. A boss 156 extending upwardly from housing 12 fits within a notch 158 in platform 142 and serves to keep platform 142 correctly aligned with respect to parts of the pathway 18 on either side of the platform 142. If the ball 16 is allowed to roll out of opening 154 it will be deposited directly onto surface 24 and thus opening 154 represents a discontinuity in the pathway 18. If the ball 16 leaves platform 142 via opening 152 it will be deposited onto transfer ramp 160 located in association with platform 142.

Platform 142 is controlled as follows. On its underneath surface is a semispherical projection 162 having a shaft 164 extending downwardly from it. The semispherical projection 162 rests on the top of boss 144 and is freely rotatable in a spherical manner on the boss 144 within the limits of travel governed by both its shape and the interaction of the platform 142 with boss 156.

Control mechanism 30 is formed on slidable member 166. On the other end of slidable member 166 is a hole 168 through which shaft 164 passes. A broad headed screw 170 fits into shaft 164 holding it within hole 168, but not otherwise fixing it to slidable member 166. Slidable member 166 has an elongated cutout 172 in its surface which fits over boss 174 formed on the bottom side of housing 12. Slidable member 166 can slide fore and aft along the boss 174 as well as pivot about the boss 174. This allows the control mechanism 30 to move in a circular manner, a straight manner or any combination thereof and motion of control mechanism 30 is transferred to motion of hole 168. The motion of hole 168 is transferred to shaft 164 causing platform 142 to tilt about boss 144 on its semispherical projection 162.

When the ball 16 is located on the platform 142 it is possible to have this ball roll in any direction through a full 360 degrees with respect to a horizontal plane. Thus movement of the ball across the platform 142 is in direct correlation with movement of the control mechanism 30. The upstanding bosses 148, however, impede this movement requiring the operator of the game to successfully traverse the ball across the surface of platform 142 between the spaces between bosses 148. If the ball is successfully deposited out of opening 152 it will be successfully deposited in the transfer ramp 160.

The transfer ramp 160 can, for the purposes of this specification be considered either a nonmovable portion of either object transfer mechanism 142, the tiltable platform or object transfer mechanism 176, stair-like cylinders.

The stair-like cylinders 176 consist of four cylinders 178, 180, 182 and 184 which are all of equal diameter, but of a diameter greater than the diameter of ball 16. Depressed slightly below the top edge of each of the cylinders 178 to 184 is an annular flange collectivley identified by the numeral 186. A circular opening collectively identified by the numeral 188 in the centers of the flanges 186 is of a smaller diameter than the ball 16 and thus the ball 16, if located within any of the cylinders 178 through 184, will rest on the surface of annular flanges 186 with a portion of its bottom located in the openings 188. The cylinders 178 through 184 are each of a progressively greater height than the cylinder before it and additionally cylinder 182 is out of line with the remainder of the cylinders.

Located within the interior of the stair-like cylinders 176 is a slidable striking member 190. Striking member 190 has two bearings collectively identified by the numeral 192 located on opposite sides which slide along two upstanding bosses identified by the numeral 194 projecting downwardly from the underside of housing 12. Striking member 190 has a metal plate 196 fixedly attached to its bottom surface which because of its weight biases the striking member 190 in a downwardly position on the bosses 194.

Control mechanism 34 is attached to pivotal lever 198 which fits underneath striking member 190. Pivotal lever 198 is pivoted about bearing surfaces collectively identified by the numeral 200 projecting from the bottom of housing 12 via two axles collectively identified by the numeral 202 which fit into the bearings 200. When control mechanism 34 is depressed lever 198 pivots and lifts against the bottom of striking member 190 sliding striking member 190 along bosses 194 in an upwardly direction.

Integrally formed on striking member 190 are four upstanding cylinders 204, 206, 208 and 210 each of which have a projection 212 on their upper surface. The projections 212 are rectilinear in shape and are located off center on the respective cylinders 204 through 210. The cylinders 204 through 210 fit within the interior of cylinders 178 to 184 respectively and when the striking member 190 is downwardly displaced by gravity the projections 212 are displaced below the annular flanges 186. When the striking member 190 is raised by depressing control mechanism 34 the projections 212 ascend through the opening 188 in the flanges 186. If the ball 16 is located within one of the cylinders 178 to 184 and the striking member 190 is rapidly raised by forcefully depressing control mechanism 34, the respective projections 212 will ascend through the opening 186 and contact the ball 16 at a point off center from the lowest point of the ball 16. Since the contact of projections 212 with the ball 16 is off center with respect to both the vertical axis of the ball and its center of gravity the action of the projection against the bottom surface of the ball 16 imparts a momentum to the ball 16 that is both upwardly directed and directed along a line passing through the projections 212 and the respective centers of cylinders 204 through 210. The projections 212 associated with cylinder 176 is located such that the ball 16 is directed toward cylinder 180. The projection 212 associated with cylinder 180 is located such that the ball 16 is projected toward cylinder 182. In a like manner the ball is projected from cylinder 182 toward cylinder 184.

If the striking member 190 strikes the ball 16 with a force sufficient to propell it upwardly and toward the next cylinder in line, the ball 16 can be successfully transferred from one cylinder to the next and eventually to cylinder 184. If the force of striking member 190 is too great the ball 16 will be propelled too far and will miss the next cylinder in line and will be deposited on surface 24. If the force of striking member 190 is too weak the ball will not be successfully lifted out of the cylinder it is resting in or it will strike the outside of the next cylinder in line and be deflected to the surface 24. Thus a discontinuity in pathway 18 exists between each of the respective cylinders 178 to 184.

When the ball comes to rest in cylinder 184 it must be given additional momentum by the striking cylinder 190 to be projected upwardly through ring 214 to successfully be transferred to transfer ramp 216. Transfer ramp 216 can be considered for the purpose of this specification as a fixed section of the next object transfer mechanism, tiltable maze 218.

Tiltable maze 218 is connected to control mechanism 36 in a manner completely analogous to the way tiltable platform 142 is connected to control mechanism 30. The tiltable maze 218 is supported on the housing 12 and tilted in a manner exactly analogous to the platform 142 and thus for the sake of brevity its parts and tilting function will not be described.

Tilting maze 218 differs from tilting platform 172, however, in that the maze 218 is composed of a bottom plate 220 having a plurality of upstanding flanges collectively identified by the numeral 222 on it which form a maze on the surface of the bottom plate 220. Fitting onto the bottom 220 is a top plate 224 which is formed to show a pathway corresponding to the maze, but which is made out of opaque material such that when the ball 16 is located on the tiltable maze 218 it cannot be seen. Once the ball 16 enters the opening 226 its movement within the tiltable maze 218 must be directed by tilting the tiltable maze 218 in a manner such that the ball even though it cannot be visably seen follows the pathway formed in top 224 before it can successfully exit out of exit 228. Included as part of the tiltable maze 218 is a blind pathway (not numbered) which is to the left of exit 228.

The next object transfer mechanism within the sequence of the pathway 18 is rotatable platform 230. Platform 230 has an object holder 232 on the end of arm 234. Arm 234 is pivotally mounted via two pins (not seen or numbered) on the ends of its furcated portions. These pins fit into holes, not numbered, located in rotatable shaft 236. An arculate cam 238 is located coaxial with shaft 236 and a cam follower 240 on the bottom of arm 232 rides over the surface of cam 238.

Shaft 236 connects to a conical member 242 identical to conical member 92. An axle 244 having a pinion 246 on one end and a clutch 250 which includes a pinion 252 on the other end traverses within housing 12 between conical members 242 and 92. Pinion 246 engages crown gear 94 and pinion 252 engages crown gear 254 on the bottom of conical member 242. Clutch 250 is identical to clutch 108 and is therefore not described. The rotary motion of control mechanism 28 is transferred from conical member 242 which in turn transfers it to rotary platform 230.

As rotary platform 230 rotates from a position wherein object holder 232 is adjacent exit 228 to a position wherein object holder 232 is adjacent to a platform 256 cam follower 240 rides against cam 238 causing the object holder 232 to first ascend and then descend.

If object holder 232 is located adjacent to exit 228 when ball 16 is expelled out of tiltable maze 218 with a particular velocity the ball 16 will come to rest in the center of object holder 232. If, however, the object holder 232 is not so positioned or if the ball 16 is expelled with too great of or too little velocity the ball 16 wil not be successfully transferred from the tiltable maze 218 to the rotating platform 230 but will be deposited either onto the surface 24 or remain lodged in the exit 228. The transfer of the ball 16 between the tiltable maze 218 and the rotary platform 230 must therefore successfully traverse the discontinuity between them.

If when the ball 16 is on the object holder 232, the movement of the rotary platform 230 is not smooth the ball 16 can be dislodged from the surface of the object holder 232 to surface 24 or could fall off the back of the game 10 to the surface supporting the game 10. When the rotary platform 230 approaches the platform 256 it must do so with a particular velocity which will cause the ball 16 to be expelled from the object holder 232 to the platform 256. If the velocity is not great enough the ball 16 will remain on the object holder 232.

From the rotary platform 230 the ball is next moved to platform 256 which serves as an immobile portion of the next object transfer mechanism, pivotal arm 258.

Pivotal arm 258 is composed of an arm 260 having a ball bucket 262 on one end and an axle (not seen or numbered) on the other end 264 which is pivoted to projections collectively identified by the numeral 266 on housing 12. Control mechanism 38 attaches to a pivotal lever 268. Lever 268 is a first class lever pivotal about axles 270 in bearings 272 on the underside of housing 12. On the end of lever 268 opposite control mechanism 238 is a striking tongue 274. Striking tongue 274 projects through an opening (not numbered) in housing 12 in a position locating it under arm 260 when the arm 260 is in the position wherein bucket 262 is next to platform 266.

When the ball 16 is located in the bucket 262 and the control mechanism is forcibly depressed the tongue 264 will strike the arm 260 causing the pivotal arm 258 to swing in an arc and deposit the ball 16 within an annular flange 276. Directly beneath annular flange 276 is a bell 278. In traversing through annular flange 276 the ball 16 strikes the bell 278 ringing it and then descends into channel 280 which leads to finishing end 22 of pathway 18. If, when the ball 16 is lodged in the bucket 262 and the arm 260 is not given sufficient momentum by tongue 274, the pivotal arm 258 will not have enough momentum to travel through its arculate pathway, but will be simply lifted from surface 24 and then descend back to surface 24. If the arm 258 descends back to surfce 24 there is a possibility that upon striking surface 24 the recoil will bounce the ball 16 out of the bucket 262 thus it is important to give the arm 258 sufficient velocity to swing through the complete arc.

I claim:

1. A game of skill which comprises:

a support housing;

a plurality of independent object transfer mechanisms of at least two nonidentical types located on said housing and arranged in a sequence with respect to one another, at least a portion of each of said object transfer mechanisms movable with respect to said housing;

a plurality of control means located on said housing, each of said control means operatively connected to at least one of said object transfer mechanisms to move with respect to said housing that portion of said object transfer mechanism which is movable;

an object pathway passing through said sequence of object transfer mechanisms, said pathway having a starting end and a finishing end, said pathway including a plurality of pathway discontinuities located in said pathway between said starting end and said finishing end, said discontinuities dividing said pathway into segments so as to interpose a discontinuity between each two adjacent segments and a segment between each two consecutive discontinuities;

a spherical object capable of traveling over each of said segments of said pathway in response to movement of said movable portion of said object transfer mechanism which contains each segment, at least a portion of said discontinuities in said pathway located between two adjacent object transfer mechanisms and said spherical object capable of traversing over said discontinuity between said two adjacent segments on said two adjacent transfer mechanisms when the movable portion of said object transfer mechanism of at least one of said two adjacent object transfer mechanisms containing said two adjacent segments located on two adjacent object transfer mechanisms is realigned with respect to the other of the two adjacent object transfer mechanisms by moving said movable portion of said one of the two object transfer mechanisms;

said spherical object capable of traveling from said starting end of said pathway to said finishing end of said pathway when said spherical object successfully travels over all of said segments of said pathway and traverses all of said plurality of discontinuities in said pathway.

2. The game of claim 1 wherein:

said spherical object rolls over at least a portion of said segments.

3. A game of skill which comprises:

a support housing;

a plurality of independent object transfer mechanisms of at least two nonidentical types located on said housing and arranged in a sequence with respect to one another, at least a portion of each of said object transfer mechanisms movable with respect to said housing;

a plurality of control means located on said housing, each of said control means operatively connected to at least one of said object transfer mechanisms to move with respect to said housing that portion of said object transfer mechanisms which is movable;

an object pathway passing through said sequence of object transfer mechanisms, said pathway having a starting end and a finishing end, said pathway including a plurality of pathway discontinuities located in said pathway between said starting end and said finishing end, said discontinuities dividing said pathway into segments so as to interpose a discontinuity between each two adjacent segments and a segment between each two consecutive discontinuities;

a spherical object capable of traveling over each of said segments of said pathway in response to movement of said movable portion of said object transfer mechanisms which contain each segment, a portion of said plurality of discontinuities in said pathway are discontinuities between two adjacent segments located on two adjacent object transfer mechanisms and said spherical object capable of traversing over said discontinuity between said two adjacent segments on said two adjacent transfer mechanisms when the movable portion of said object transfer mechanism of at least one of said two adjacent object transfer mechanisms containing said two adjacent segments located on two adjacent object transfer mechanisms is realigned with respect to the other of the two adjacent object transfer mechanisms by moving said movable portion of said one of the two object transfer mechanisms, the remaining portion of said discontinuities in said pathway are discontinuities located between two adjacent segments located on a single object transfer mechanism and said spherical object capable of traversing over said discontinuity between said two adjacent segments located on said single object transfer mechanism by moving the movable portion of said object transfer mechanisms containing said two adjacent segments located on said single object transfer mechanism;

said spherical object capable of traveling from said starting end of said pathway to said finishing end of said pathway when said spherical object successfully travels over all of said segments of said pathway and traverses all of said plurality of discontinuities in said pathway.

4. The game of claim 3 wherein:

said spherical object rolls over at least a portion of said segments.

5. The game of claim 4 wherein:

said spherical object is carried over at least a portion of said segments.

6. The game of claim 5 wherein:

said spherical object is propelled over at least a portion of said segments.

7. The game of claim 3 wherein:

at least one of said object transfer mechanisms comprises a plurality of surfaces each supported by a fulcrum means located intermediate the ends of said surface;

said surfaces located adjacent to each other in a sequence such that one end of each of the adjacent surfaces is located next to one end of the other of each of the adjacent surfaces, said end of said adjacent surfaces located next to each other including connecting means connecting said ends of said surfaces located adjacent to each other so as to transmit movement of one surface to the surface adjacent to it.

8. The game of claim 3 wherein:

at least one of said transfer mechanisms is rotatably mounted on said housing and includes object holding means located on said transfer mechanism and capable of supporting said object, such that when said spherical object is supported by said object holding means said object transfer mechanism is capable of moving said spherical objects through an arc.

9. The game of claim 3 wherein:

at least one of said object transfer mechanisms includes a surface supported on said housing which is tiltable with respect to the horizontal such that said spherical object is capable of rolling in any direction across said surface.

10. The game of claim 9 wherein:

said surface includes interference means located on said surface and interfering with the ability of said spherical object to roll in certain directions across said surfce;

cover means covering said surface such that said spherical object is hidden from visual observation while on said surface.

11. The game of claim 9 wherein:

said housing includes a hollow upstanding boss;

said surface includes a semispherical projection located on the underside of said surface and including a shaft projecting downwardly from said semispherical projection, said semispherical projecting fitting on said boss to support said surface over said boss and said shaft projecting through said boss;

said control means operatively connected to said object transfer mechanism includes a boss located in said housing, an elongated member having a slot passing vertically through the central portion of the member and fitting over said boss, attaching means on one end of said member capable of attaching to said shaft projecting downwardly from said semispherical projection, and a means for moving said elongated member located on the other end of said member such that when said means for moving said member is manipulated by the operator of the game said manipulation is transferred to said elongated member and from said elongated member to said shaft projecting downwardly from said semispherical projection moving said semispherical projection in said upstanding boss.

12. The game of claim 3 wherein:

at least one of said object transfer mechanisms includes a plurality of upstanding cylinders each having a centralized cavity passing through the longitudinal axis of said cylinder, each cylinder sized to allow said spherical object to fit within said cylinder but not within said centralized cavity;

a plurality of plunger mechanisms located in association with said cylinder such that one plunger mechanism is capable of traveling through the longitudinal axis of each of said cylinders through said centralized cavity to displace said object from said cylinder.

13. The game of claim 3 wherein:

at least one of said object transfer mechanisms includes an arm having two ends, one end pivotally mounted on said housing and the other end including an object retaining means capable of receiving said object and retaining said object as said arm pivots on said housing to move said object through an arc and release said object after said object has moved through said arc.

14. The game of claim 3 wherein:

at least one of said transfer mechanisms is rotatably mounted on said housing and includes object holding means located on said transfer mechanism and capable of supporting said object, such that when said spherical object is supported by said object holding means said object transfer mechanism is capable of moving said spherical objects through an arc;

at least one of said object transfer mechanisms includes a surface supported on said housing which is tiltable with respect to the horizontal such that said spherical object is capable of rolling in any direction across said surface;

at least one of said object transfer mechanisms includes a plurality of upstanding cylinders each having a centralized cavity passing through the longitudinal axis of said cylinder, each cylinder sized to allow said spherical object to fit within said cylinder but not within said centralized cavity;

a plurality of plunger mechanisms located in association with said cylinder such that one plunger mechanism is capable of traveling through the longitudinal axis of each of said cylinders through said centralized cavity to displace said object from said cylinder;

at least one of said object transfer mechanisms includes an arm having two ends, one end pivotally mounted on said houing and the other end including an object retaining means capable of receiving said object and retaining said object as said arm pivots on said housing to move said object through an arc and release said object after said object has moved through said arc.

15. The game of claim 14 wherein:

said housing includes a sloping surface, said object transfer mechanism located above said sloping surface.

16. The game of claim 3 wherein:

said housing includes a sloping surface, said object transfer mechanism located above said sloping surface.

* * * * *